US008128380B2

(12) United States Patent
Guggemos et al.

(10) Patent No.: US 8,128,380 B2
(45) Date of Patent: Mar. 6, 2012

(54) AXIAL PISTON PUMP OR MOTOR OF THE SWASHPLATE OR BENT AXIS TYPE

(75) Inventors: Konrad Guggemos, Unterthingau (DE); Guenther Groeger, Lengenwang (DE); Richard Heindl, Marktoberdorf (DE); Herbert Leonhart, Marktoberdorf (DE)

(73) Assignee: AGCO GmbH, Marktoberdorf (DE)

( * ) Notice: Subject to any disclaimer, the term of this patent is extended or adjusted under 35 U.S.C. 154(b) by 1202 days.

(21) Appl. No.: 11/755,077

(22) Filed: May 30, 2007

(65) Prior Publication Data

US 2007/0289441 A1 Dec. 20, 2007

(30) Foreign Application Priority Data

Jun. 18, 2006 (GB) ..... 0614188.1

(51) Int. Cl.
*F04B 1/04* (2006.01)

(52) U.S. Cl. ..... 417/273; 417/522; 91/499

(58) Field of Classification Search ..... 417/269, 417/273, 522; 91/499
See application file for complete search history.

(56) References Cited

U.S. PATENT DOCUMENTS 3,585,901 A 6/1971 Moon, Jr. et al.
(Continued)

FOREIGN PATENT DOCUMENTS

DE 10206958 A1 8/2003
(Continued)

OTHER PUBLICATIONS

Search Report for Related Application, EP 1 881 196 A1.
(Continued)

*Primary Examiner* — Charles Freay
*Assistant Examiner* — Patrick Hamo

(57) ABSTRACT

An axial piston machine, in particular an axial piston pump, of the swashplate or bent axis type, is described, wherein a fixed control plate (12), which comprises at least one control passage (12*a*) consisting of a plurality of control passage sections (12*b*, 12*c*) separated from each other by bridges (12*d*), is arranged between a cylinder drum, rotatable in both directions of rotation, and a fixed housing. The object of the invention is to design the control plate of an axial piston machine in such a way that damage by cavitation to the structural parts is prevented over the entire extent of the control passages for the supply and removal of the operating fluid. For this purpose the at least one control passage (12*a*) in the region at least of one bridge (12*d*) is provided with a pressure balance opening (13) connecting the surfaces of the control plate (12) with one another.

7 Claims, 3 Drawing Sheets

U.S. PATENT DOCUMENTS

| | | | | | |
|---|---|---|---|---|---|
| 3,633,463 | A | | 1/1972 | Ninomiya | |
| 3,699,845 | A | * | 10/1972 | Ifield | 91/6.5 |
| 4,075,933 | A | | 2/1978 | Stephens | |
| 4,550,645 | A | * | 11/1985 | Beck, Jr. | 91/499 |
| 5,572,919 | A | * | 11/1996 | Ishizaki | 91/499 |
| 6,361,285 | B1 | * | 3/2002 | Lehner | 417/269 |
| 6,442,934 | B1 | * | 9/2002 | Okuda et al. | 60/451 |
| 6,736,048 | B2 | * | 5/2004 | Riedhammer et al. | 91/504 |
| 2005/0226748 | A1 | * | 10/2005 | Gray et al. | 417/440 |

FOREIGN PATENT DOCUMENTS

| | | | |
|---|---|---|---|
| DE | 102004007933 | B3 | 6/2005 |
| FR | 1288771 | A | 3/1962 |
| GB | 1031735 | A | 6/1966 |
| GB | 1082807 | A | 9/1967 |

OTHER PUBLICATIONS

Search Report for Related Application, GB 0614188.1.

* cited by examiner

AXIAL PISTON PUMP OR MOTOR OF THE SWASHPLATE OR BENT AXIS TYPE

This application is based on, and claims the benefit of priority to, UK application GB 0614188.1, filed 18 Jun. 2006, which priority application is hereby incorporated by reference.

BACKGROUND OF THE INVENTION

1. Field of the Invention

The invention relates to an axial piston pump or motor, of the swashplate or bent axis type, wherein a fixed control plate, which comprises at least one control passage, consisting of a plurality of control passage sections separated from each other by bridges, is arranged between a cylinder drum, rotatable in both directions of rotation, and a fixed housing of the pump or motor.

2. Description of Related Art

Such an axial piston pump is described in German Patent DE 37 25 361 C2. In order to reduce the running noise the control plate of this known axial piston pump, in the transition regions between the control passages for the supply or removal of the operating fluid, that is to say the high pressure passage and the low pressure passage, comprises a pressure balancing passage, through which a relatively gentle adaptation of the cylinder pressures occurs, before the cylinder opening of the respective cylinder lies in the cross sectional region of the high pressure passage. During this operation a fluid jet which, due to jet erosion and cavitation erosion causes wear damage on the control passage walls and the control plate, passes through the pressure balancing passage. In order to prevent such erosion an interference passage is allocated to the pressure balancing passage, which produces an interference jet intersecting the fluid jet and thereby weakens this.

It has now been shown with axial piston pumps that also outside the transition area between the control passages for the supply and removal of the operating fluid, damage by cavitation can occur on structural part surfaces cooperating with the control plate, which cannot be prevented by a combination of a pressure balancing passage with an interference passage. In particular such erosion has been observed not only in the high pressure region, but also in the low pressure region.

With this as the starting point the object of the invention is to provide a control plate for an axial piston pump or motor which is designed in such a way that damage to structural parts is prevented over the entire extent of the control passages for the supply and removal of the operating fluid.

BRIEF SUMMARY OF THE INVENTIONS

Thus in accordance with the invention, order to achieve this object it is proposed that the at least one control passage, in the region at least of one bridge is provided with a pressure balance opening connecting the surfaces of the control plate with one another.

Through the invention, the surfaces of the control plate in the region of the bridges, where low pressure zones can develop are reduced. Thus the formation of gas or water vapour bubbles which occur as a pre-condition for cavitation is reduced so that damage by cavitation erosion to structural surfaces cooperating with the control plate in the region of the control passages for the supply and removal of the operating fluid is prevented. Depending on operating parameters, such as size, pressure level, speed of revolution of the cylinder drum, cylinder stroke, the geometry can be adapted very simply.

The design of the control plate can be adapted accordingly for use as an axial piston motor as well as a pump.

BRIEF DESCRIPTION OF DRAWINGS

One embodiment of the invention will now be described below with reference to the accompanying drawings in which.

DETAILED DESCRIPTION OF PREFERRED EMBODIMENTS

Figure 1:
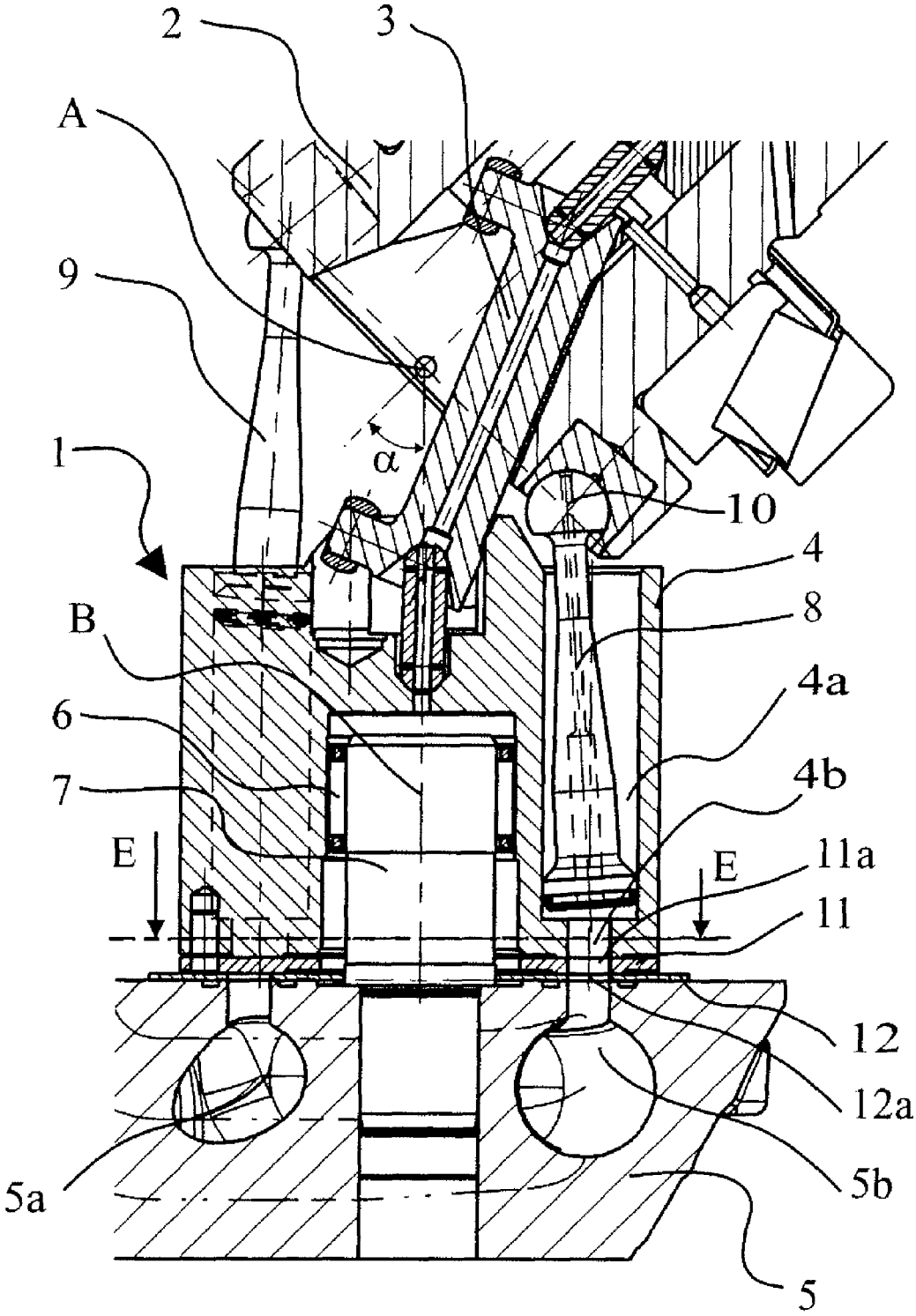
FIG. 1 is a sectional view of an axial piston pump of the swashplate type.

The axial piston pump 1 illustrated in FIG. 1 is accommodated in a machine housing, not shown, and substantially consists of a driving flange 2, rotatably mounted in the machine housing, a cylinder drum 4 mechanically connected to the driving flange 2 by a tripod joint 3 and a housing 5, not rotatable relative to the machine housing, but pivotable about a fixed machine housing axis A over a pivoting angle range $\alpha$.

The cylinder drum 4 is rotatably mounted about the axis B via an antifriction bearing 6 on a bearing journal 7 protruding from the housing 5. A plurality of pistons 8, 9 displaceable in cylinder chambers 4*a*, parallel in axis, of the cylinder drum 4 are held on the driving flange 2 by means of a ball joint 10 and during rotation of the cylinder drum 4 perform a stroke movement dependent as to its size on the set pivoting angle $\alpha$. In FIG. 1 the piston 8 is situated at its lowest position, wherein the entire usable operating fluid is forced out of the cylinder chamber 4*a* through a cylinder chamber opening 4*b*. The piston 9 is correspondingly situated in the diametrically opposite cylinder chamber at its highest position, wherein the cylinder chamber is completely filled with operating fluid. The delivery volume of the axial piston pump therefore depends on the set pivoting angle $\alpha$ of the housing 5.

In order to adjust the delivery volume the housing 5 together with the cylinder drum 4 is swivelled about the axis A running perpendicularly to the plane of FIG. 1 into a desired position within the available pivoting angle range $\alpha$. In this case, by increasing the pivoting angle the stroke of the pistons 8, 9 is augmented as a result of which the delivery volume rises. When the housing 5 is not pivoted no flow occurs. For the supply or removal of the operating fluid into or out of the cylinder chambers 4*a*, two fluid flow passages 5*a*, 5*b* are provided in the housing 5.

A bearing plate 11 and a control plate 12 are arranged between the cylinder drum 4 and the housing 5. The bearing plate 11 is connected, secured against rotation, to the cylinder drum 4. It serves as an axial bearing of the cylinder drum 4 and is provided with openings 11*a*, which correspond to the cylinder chamber openings 4*b* in size and position. The control plate 12 is connected, secured against rotation, to the housing 5 and can be easily replaced for maintenance reasons as well as for adaptation to various operating conditions. It is provided with a kidney-shaped control passage 12*a* consisting of control passage sections 12*b*, 12*c*, which are separated from each other by bridges 12*d* and serve to control the flow of the operating fluid into and out of the cylinder chambers 4*a*.

During operation of the axial piston pump with the drum moved into the pivot position illustrated in FIG. 1, the operating fluid is pumped from the chamber 4*a* via the cylinder chamber opening 4*b*, the openings 11*a* in the bearing plate 11 and the control passage sections 12*b* or 12*c* in the control plate 12 to the control passage 5*b* of the housing 5, until it reaches the lowest position shown of the piston 8. From there the operating fluid flows to a port, not illustrated, where it can be removed. Another port, likewise not illustrated, serves to feed the operating fluid back to the axial piston pump 1 via the fluid flow passage 5*a* of the housing 5.

Figure 2:
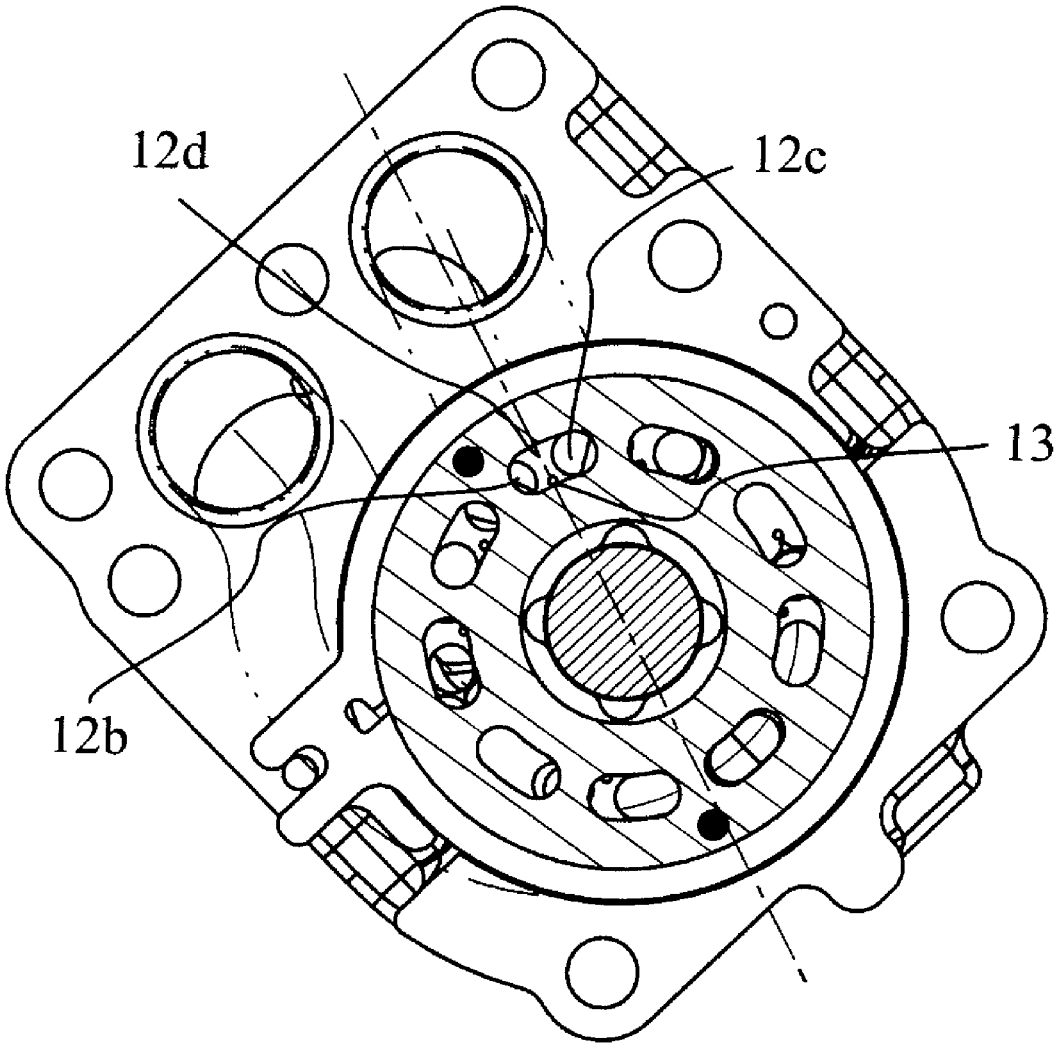
FIG. 2 is a sectional view along line E-E in FIG. 1.

Due to the rotation of the cylinder drum 4 about the bearing journal 7 during operation, as is evident from the geometry of FIG. 2, the free cross section available for the flow of the operating fluid varies constantly, as a result of the constantly changing position of the control passage sections 12*b*, 12*c* in the control plate 12 relative to the openings 11*a* in the bearing plate 11. Thus, a corresponding variation of the pressure and flow-rate parameters of the operating fluid also takes place. With conventional axial piston machines the hydrostatic pressure below the bridges 12*d* falls away steeply and gas and/or water vapour bubbles form due to the high and varying overflow-rates of the operating fluid. These bubbles are carried by the flowing fluid into regions of higher pressure, predominantly to the edges of the fluid flow passages 5*a*, 5*b*, which lie in the region of the contact area of the control plate 12 with the housing 5, and implode there. These implosions lead to pressure peaks, which cause erosion of the material surface at the edges of the fluid flow passages 5*a*, 5*b*.

Figure 3:
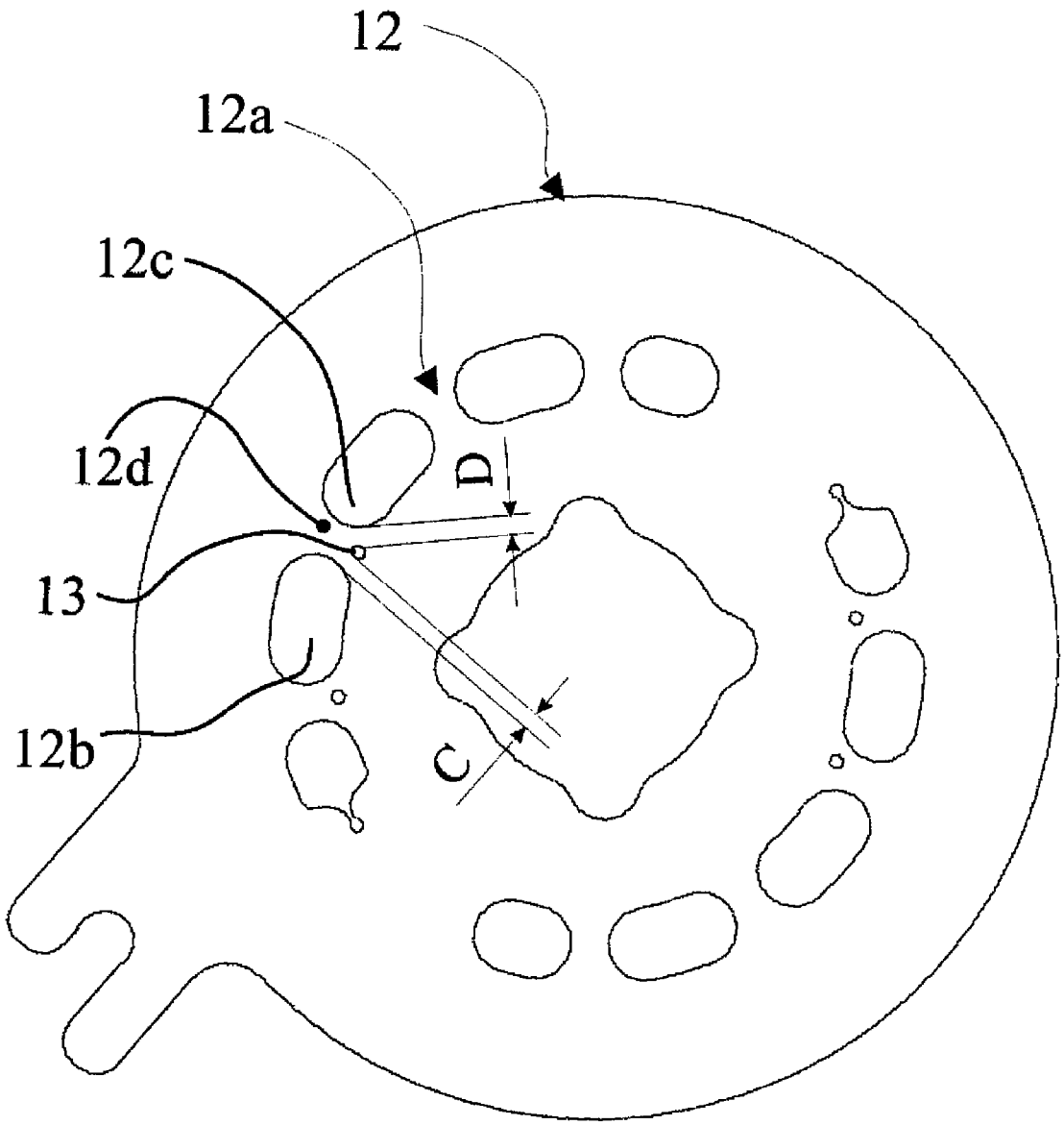
FIG. 3 is a plan view of the control plate used in the pump of FIG. 1.

According to the invention, as is evident from FIGS. 2 and 3, in order to improve the pressure and flow behaviour in the bridges 12*d*, a pressure balance opening 13 is provided between the control passage sections 12*b*, 12*c*, through which balancing of the pressures prevailing in the fluid flow passages 5*a*, 5*b* and in the cylinder chamber 4*a* or the cylinder chamber opening 4*b* occurs.

So that the bridge 12*d* between the adjacent control passage sections 12*b*, 12*c* is not weakened too much, the distance C from the pressure balance opening 13 to the control passage section 12*b* and the distance D to the control passage section 12*c* should be selected as large as possible. This results in an expedient arrangement of the pressure balance opening 13 in the inside or outside boundary region of the bridge 12*d*.

In the present exemplary embodiment the size and position of the pressure balance opening 13 was specified for a certain size with defined operating parameters. The pressure balance opening 13 thereby lies on the inner side of the bridge 12*d*. For other operating parameters (size, pressure level, number of cylinders, speed of revolution of the cylinder drum, piston stroke), the position, size and shaping of the pressure balance opening 13 and the angle of the balance opening 13 to the plane of the control panel 12 can be adapted.

The inventive arrangement of the control plate is suitable not only for the operation of an axial piston pump, but also for an axial piston motor. In this case, the position and design of the pressure balance opening 13 should be adapted, based on the change in the direction of pumping or rotation.

We claim:

1. An axial piston fluid pump or motor of the swashplate or bent axis type having a fixed housing which includes two fluid flow passages which open through a support surface of the housing, a cylinder drum rotatable in both directions relative to the fixed housing and including pistons reciprocating in chambers in the drum, and a control plate clamped between the rotatable drum and the support surface of the housing, the control plate being fixed relative to housing and having two control passages, each control passage being in register with a respective fluid flow passage in the housing and comprising a plurality of individual circumferentially spaced control passage sections through which fluid flows between the fluid flow passages and the cylinder chambers, the control passage sections of each control passage being separated from each other by bridges, and at least one of the bridges between the passage sections of each control passage being provided with a pressure balance opening through the bridge connecting one side of the control plate with the other side of the control plate for the flow of fluid between the fluid flow passages and the cylinder chambers.

2. An axial piston machine according to claim 1, in which the pressure balance opening is provided as a bore through the control plate.

3. An axial pump or motor according to claim 1, in which the position of the pressure balance opening is dependent on operating parameters.

4. An axial pump or motor according to claim 1, in which the diameter of the pressure balance opening is dependent on operating parameters.

5. An axial pump or motor according to claim 1, in which the pressure balance opening, according to operating conditions, is placed at an angle to the plane of the control plate.

6. An axial pump or motor according to claim 3, wherein the operating parameters are selected from the group consisting of piston displacement, speed of revolution, load, and operating fluid.

7. An axial pump or motor according to claim 4, wherein the operating parameters are selected from the group consisting of piston displacement, speed of revolution, load, and operating fluid.

* * * * *